United States Patent [19]

Yamamoto

[11] 4,192,115

[45] Mar. 11, 1980

[54] ELONGATED SHINGLE ASSEMBLY

[76] Inventor: Ryohei Yamamoto, No. 9 Shinonomecho-5, Chitose, Hokkaido, Japan

[21] Appl. No.: 880,564

[22] Filed: Feb. 23, 1978

Related U.S. Application Data

[63] Continuation-in-part of Ser. No. 767,119, Feb. 9, 1977, abandoned, which is a continuation-in-part of Ser. No. 603,949, Aug. 12, 1975, abandoned.

[51] Int. Cl.[2] ..... E04C 1/34; E04D 1/36

[52] U.S. Cl. ..... 52/468; 52/528

[58] Field of Search ..... 52/460, 462, 584, 468, 52/461, 467, 472, 540, 515, 465, 470, 578, 464, 459, 466, 528

[56] References Cited

U.S. PATENT DOCUMENTS

| | | | |
|---|---|---|---|
| 453,470 | 6/1891 | Geiger et al. | 52/461 |
| 1,116,185 | 11/1914 | White | 52/515 X |
| 1,334,607 | 3/1920 | Graff | 52/584 |
| 1,865,674 | 7/1932 | Carter | 52/459 |
| 2,234,799 | 3/1941 | Eason | 52/459 X |
| 2,358,550 | 9/1944 | Williams | 52/515 |
| 2,638,162 | 5/1953 | Hertlinger et al. | 52/468 X |
| 2,855,871 | 10/1958 | Huntington | 52/462 X |
| 3,149,436 | 9/1964 | Varlonga | 52/460 |
| 3,292,334 | 12/1966 | Craig | 52/540 X |
| 3,376,680 | 4/1968 | Gyekis | 52/467 X |
| 3,603,056 | 9/1971 | Roth et al. | 52/460 |
| 3,667,182 | 6/1972 | Stemler | 52/461 X |
| 3,842,550 | 10/1974 | Duquette | 52/528 X |

FOREIGN PATENT DOCUMENTS

| | | | |
|---|---|---|---|
| 139050 | 10/1950 | Australia | 52/520 |
| 209725 | 2/1956 | Australia | 52/466 |
| 209726 | 2/1956 | Australia | 52/461 |
| 263657 | 3/1965 | Australia | 52/46 |
| 89279 | 9/1960 | Denmark | 52/528 |
| 1293934 | 4/1962 | France | 52/466 |
| 644518 | 9/1962 | Italy | 52/584 |
| 733606 | 7/1955 | United Kingdom | 52/461 |
| 816415 | 7/1959 | United Kingdom | 52/472 |

*Primary Examiner*—Leslie Braun
*Attorney, Agent, or Firm*—Fleit & Jacobson

[57] ABSTRACT

An elongated shingle assembly and method for assembling the same. The assembly extends vertically from the top of a roof to the eaves and has a plurality of elongated flat shingle members interconnected by connection assemblies. Each connection assembly has a flange member with two vertical walls on opposite sides thereof and a shelter member connecting the walls and covering tops of the walls. The bottom of each wall extends away from the wall in a horizontal direction to form a member adapted for connection to a roof. A pair of flat shingle members, each having a brim portion, are brought to fit against the outside surfaces of the vertical walls of the flange member and positioned under the shelter member, with the brims being forcibly curled in a vertically upward direction so as to be covered by flaps formed at both sides of the shelter member. A deforming tool is then positioned in a groove defined on the top surface of the shelter member and actuated to move the flaps into a position covering and gripping the brim portions.

7 Claims, 8 Drawing Figures

ELONGATED SHINGLE ASSEMBLY

BACKGROUND AND SUMMARY OF THE INVENTION

This invention is a continuation-in-part of Ser. No. 767,119, filed Feb. 9, 1977, now abandoned which is a continuation-in-part of Ser. No. 603,949, filed Aug. 12, 1975, and now abandoned.

This invention relates to an elongated shingle assembly and a method for assembling the same. More particularly, the invention relates to an elongated shingle assembly which is waterproof and easily constructed.

An object of this invention is to provide an elongated shingle assembly integrally formed to extend in a single piece from the ridge of a roof to the eaves, and which is easily and inexpensively constructed so as to be waterproof.

Another object of the present invention is to provide a method of constructing a roof covering as a whole, using elongated shingles impregnated with asphalt and a novel method of joining the elongated shingles.

In accordance with one embodiment of this invention, an elongated shingle assembly comprises a plurality of elongated flat shingle members extending vertically from the top of the eaves of a roof and interconnected by connection assemblies. Each connection assembly has a flange member with two vertical walls and a shelter member connecting the walls and covering tops of the walls. A flat shingle member cut from a belt-like semi-flexible cardboard impregnated with asphalt and having two parallel brim portions is positioned adjacent the connection assembly with one of the brim portions brought to fit against an outside surface of one of the vertical walls of the flange member and positioned under the shelter member. The brim portion is forcibly curled in a vertically upward direction during the assembly operation so as to be covered by an outwardly extending flap, formed at the side of the shelter member. A second similar shingle member is positioned in the same manner adjacent the outside surface of the other of the vertical walls of the flange member. A deforming tool is then positioned in a groove defined on the top surface of the shelter member and actuated to move the flaps into a position covering and gripping the brim portions to form an essentially watertight connection between the two brim portions.

Other features and advantages will be apparent from the following description with reference to the accompanying drawings as follows:

DESCRIPTION OF THE PREFERRED EMBODIMENTS

Figure 1:
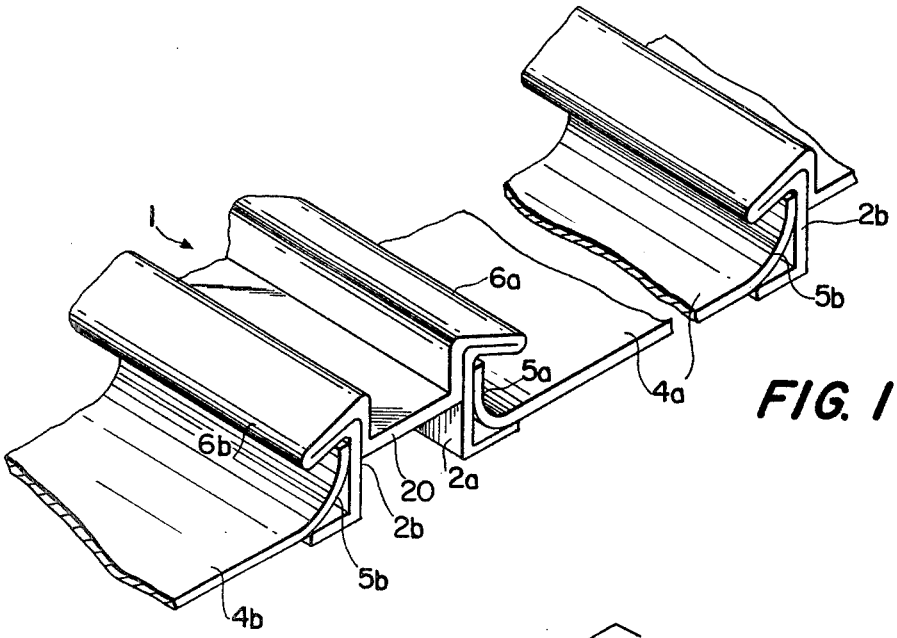
FIG. 1 is a perspective view of one embodiment of an elongated shingle assembly of the present invention.
Figure 2:
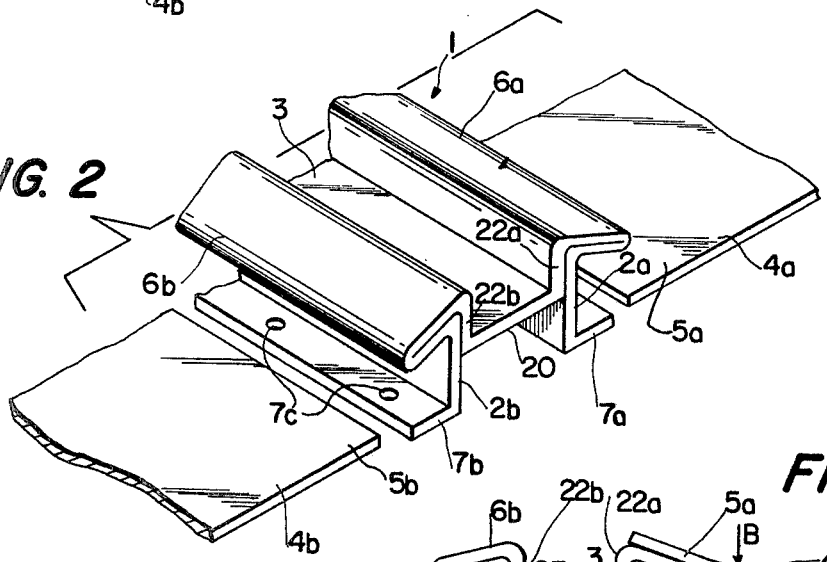
FIG. 2 is a perspective view of the components of the elongated shingle assembly of FIG. 1 before assembly.

A first embodiment of this invention is illustrated in FIGS. 1 to 3*c* wherein an elongated shingle assembly comprises a plurality of connection assemblies or flange members, two of which labelled 1 are illustrated, interconnecting pairs of flat shingle members 4*a* and 4*b*. Each of the flange members 1 has two vertical walls 2*a* and 2*b* and a shelter member 3 integrally formed with the vertical walls 2*a* and 2*b*. In this embodiment, the flange member having two vertical walls 2*a* and 2*b* and the shelter member 3 is formed as a unitary assembly from a single piece of material, such as sheet metal. Attaching rims 7*a* and 7*b* form a base for the flange member, and can be adapted to be attached to the base plate or base of the roof by nails, adhesive, or other bonding means during the shingle assembly operation. Also, the rims 7*a* and 7*b* can include preformed holes or openings 7*c* to facilitate attachment.

The elongated shingle assembly further comprises a pair of flat shingle members 4*a* and 4*b* which are cut from a belt-like, semi-flexible cardboard impregnated with asphalt. The shingle members 4*a* and 4*b* have a pair of brim, or edge portions 5*a* and 5*b*, respectively, which are positioned against outside surfaces of the vertical walls 2*a* and 2*b*. Shelter member 3 further includes a pair of flaps 6*a* and 6*b* formed by portions extending from or above the upper ends of the vertical walls 2*a* and 2*b* and overlapped at both sides of the shelter member 3. The flaps 6*a* and 6*b* are interconnected with a horizontal plate member 20, which forms part of the shelter member 3, by means of a pair of vertical members 22*a* and 22*b* which are connected to the flaps 6*a* and 6*b*. The horizontal plate member 20 cooperates with the vertical members 22*a* and 22*b* to define a concave guide zone or groove 23 for guiding a deforming tool 24 that bends the flaps towards the vertical walls thereby covering and gripping the brim portions between the flaps and the walls.

Figure 3A:
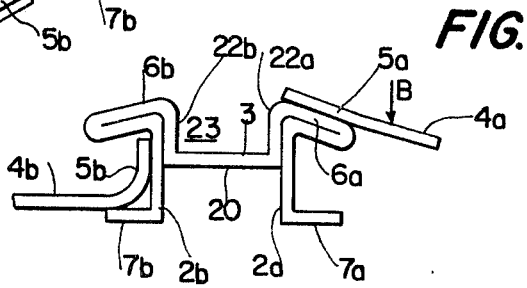
FIGS. 3*a* to 3*c* are vertical cross-sectional views of the elongated shingle assembly of FIGS. 1 and 2 illustrating the order of assembly.
Figure 3B:
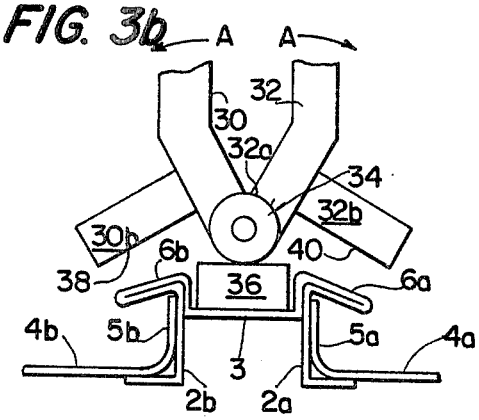
Figure 6:
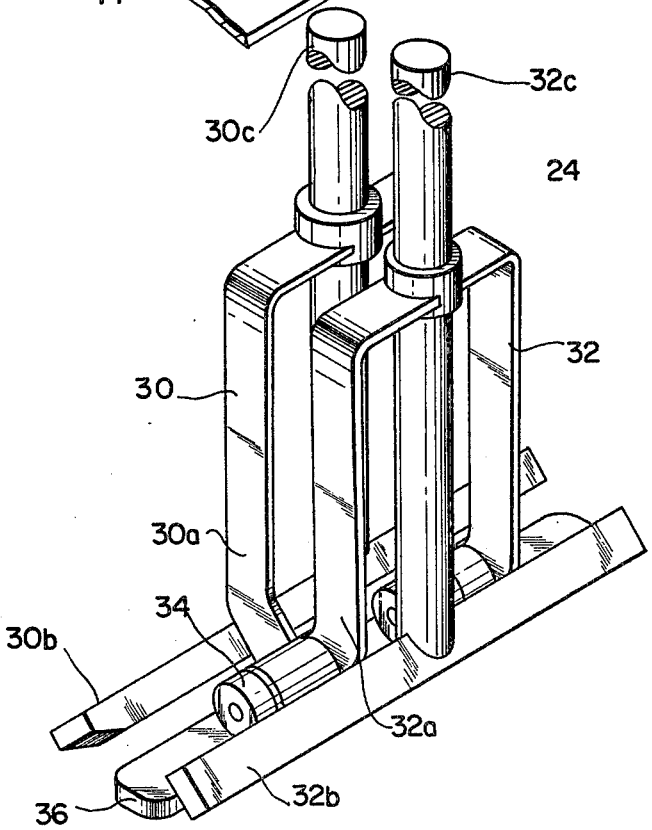
FIG. 6 is a perspective view of a deforming tool used in the assembling of the elongated shingle assemblies of FIGS. 1–5.

One embodiment of the deforming tool 24, as best seen in FIG. 6, includes two arms 30 and 32 having their ends 30*a* and 32*a* interconnected at a hinge 34 so that the other ends 30*c* and 32*c* of the arms can freely open and close. A guide member 36 having a shape determined by the shape of groove or guide surface 23 is connected with the hinge 34. Thus, in the illustrated embodiment, both groove 23 and guide member 36 have a generally rectangular cross section. Fastening members 30*b* and 32*b* extend from or are attached to arms 30 and 32 a predetermined distance from the ends 30*a* and 32*a*, respectively. The fastening members 30*b* and 32*b* have generally planer faces 38 and 40. The relationship between guide member 36 and fastening members 30*b* and 32*b* is such that when guide member 36 is positioned in groove 23, as shown in FIG. 3*b*, with its bottom substantially in contact with plate member 20 and portions of its sides substantially in contact with vertical members 22*a* and 22*b*, the planer faces 38 and 40 are essentially parallel to the top surfaces of flaps 6*a* and 6*b* and either contact or are spaced a short distance from the flaps. (For purposes of clarity, the spacing between the planer faces and flaps has been exaggerated in FIG. 3*b*.) The relationship is also such that when ends 30*c* and 32*c* of arms 30 and 32 are subsequently moved in the direction of the arrows A in FIG. 3*b*, the guide member 36 is forced towards plate member 20. This movement of ends 30*c* and 32*c* also moves fastening members 30*b* and 32*b* from the position illustrated in FIG. 3*b* to that illustrated in FIG. 3*c*.

In assembling the first embodiment, a first flange member 1 or group of flange members 1 are positioned on a roof on a vertical line extending from the top of the roof to the eaves of the roof. The number of flange members used is determined by the distance (d) from the top of the roof to the eaves and the length (l) of the flange members 1. For instance, if the distance (d) is 20 feet and the length (l) is 10 feet, two flange members would be used. It will be appreciated that the joints between the ends of the flange members must be appropriately sealed to prevent leakage. Alternatively, a single 20 foot-long flange member can be used. Additional flange members 1 are then positioned parallel to the first flange member. The distance between adjacent flange members is slightly less than the width of the elongated shingle members 4*a* and 4*b*. After the flange members have been positioned, shingle members are positioned between adjacent flange members with their brim portions 5*a* and 5*b* brought into contact with the facing outer surfaces of the vertical walls of adjacent flange members and with the brim portions forcibly curled or deformed in a vertically upward direction. Also, the brim portions cover the base portion or rims of the flange member thereby reducing the risk of leakage through the points where the flange member is attached to the roof.

One method useful for the proper positioning of the brim portions involves placing the elongated shingle member with its brim portions on top surfaces of the flaps of adjacent flange members. For instance, as shown in the right-hand side of FIG. 3*a*, brim portion 5*a* is positioned on top of flap 6*a*. Pressure in a direction downward or towards the roof is then applied on a portion or portions of the shingle member spaced from the flange members, as shown by the arrow B in FIG. 3*a*. The brim portion then "snaps" into a position under the flaps curled forcibly upwardly against the outside of vertical walls of the flange members, as shown in the left-hand side of FIG. 3*a*. Thus, the flaps prevent movement of the brim portions caused by the resiliency of the shelter member. To ensure retention of the brim portions against the vertical walls of the flange members, either or both the brim portions and the vertical walls can be coated with an adhesive, for instance by spraying, before the brim portions are "snapped" into position.

Figure 3C:
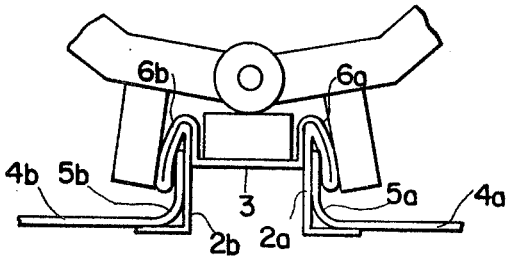

After brim portions 5*a* and 5*b* of two elongated shingle members 4*a* and 4*b* have been positioned against the vertical walls 2*a* and 2*b* of a flange member 1, the deforming tool 24 is positioned with its guide member 36 in groove 23 of the shelter member 3 and its fastening members 30*b* and 32*b* resting on or slightly spaced from the top surface of flaps 6*a* and 6*b*, respectively. Ends 30*c* and 32*c* of arms 30 and 32 are then moved away from each other so that flaps 6*a* and 6*b* are bent to press against and grip the brims 5*a* and 5*b*, as shown in FIG. 3*c*. The flaps extend in the vertical direction so that the shingle edges are covered and waterproof. Thus, the shelter member 3 acts not only to protect the edges of the shingles from adverse weather conditions, but also serves as both a guide for a deforming tool and a gripping or retaining member to keep the shingle member in place. Since the flat shingle member extends from the top of the roof to the eaves, and since the edges of brim portions of the shingle member are gripped by the deformed flaps of two adjacent connection assemblies, a watertight elongate shingle assembly is formed. It is to be noted that the upward curl of the longitudinally extending edges of the brim portions define a channelway above a center portion of the shingle member which facilitates run-off of water from the shingle assembly.

Figure 4:
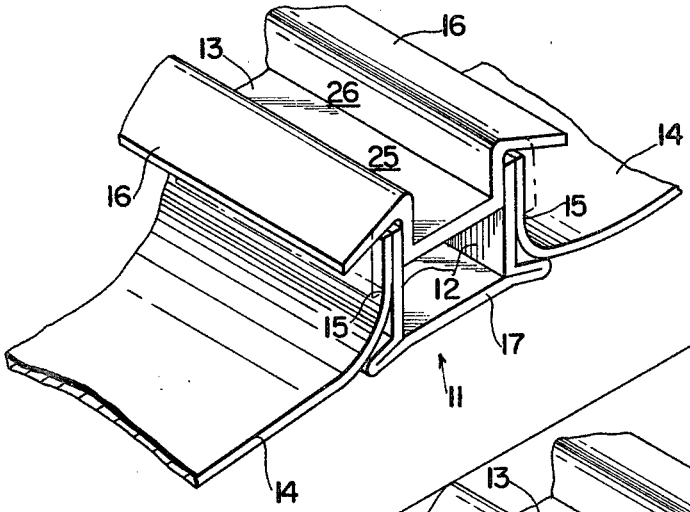
FIG. 4 is a perspective view of another embodiment of the present invention.
Figure 5:
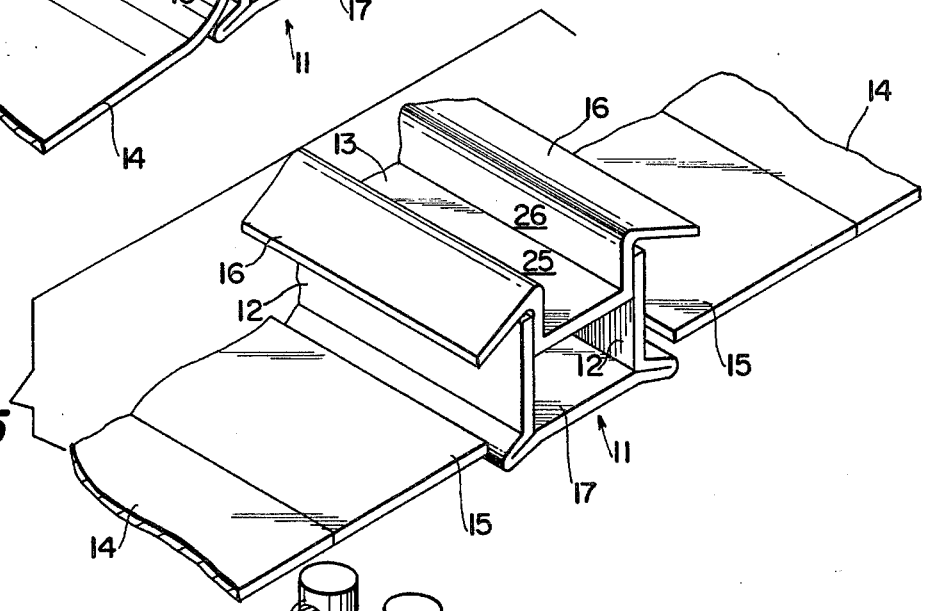
FIG. 5 is a perspective view of the elongated shingle assembly of FIG. 4 before assembly.

FIGS. 4 and 5 show a second embodiment which is distinguished from the first embodiment by the construction of a separate flange member 11 and shelter member 13. The flange member 11 has two vertical walls 12 spaced apart and parallel to each other, and an attaching plate 17 forming a base portion from which the two vertical walls extend. The shelter member 13 is mounted on the flange member 11. The shelter member 13 has two flaps 16 interconnected by means of horizontal member 25 and vertical members 26. The shingle member 14 is cut into the same shape as that of the first embodiment, and has two brim portions 15 which are brought into contact with the vertical walls 12 of adjacent flange members 11.

In assembling the second embodiment, the brims 15 are brought into contact with the outer surfaces of the vertical walls 12 with the brims being forcibly deformed along the outer sides of the vertical walls 12 during the assembly operation, and then the shelter member 13 is placed on the upper ends of the brims 15 and walls 12. Finally, the flaps 16 are bent as shown in phantom line in FIG. 4 to press against the outer surfaces of the brims 15 so that the edges of the shingle member are covered and waterproof.

In another method of assembling the elongated shingle assembly of the present invention, placement of flange members and positioning of shingle members occurs seriatim. Two flange members are placed and then a shingle member is positioned between the flange members. Placement of flange members and shingle members then alternates until the roof is covered. Deformation of the flaps of the flange members is accomplished in the previously described manner.

The figures described herein represent preferred embodiments of the shingle assembly; however, other embodiments and numerous modifications are well within the scope of the present invention. For instance, a power-operated deforming tool can be used in place of or in addition to the previously described manually operated deforming tool. This and other embodiments and modifications will be apparent to those of ordinary skill in the art.

I claim:

1. An elongated shingle assembly including, (a) a flange member comprising a base portion, and a pair of vertical walls extending from said base portion, said walls being spaced apart and parallel to each other and having inner surfaces facing each other and outer surfaces facing away from each other, (b) a pair of flat shingle members each having an upwardly extending brim portion in an assembled position, (c) a shelter member means joining said shingle members to said flange member and protecting the shingle members comprising, a horizontal member extending between said pair of vertical walls, a pair of in situ deformable flap members each extending adjacent to one said vertical walls, and means for interconnecting said pair of flap members with said horizontal member, whereby said shingle members are joined to said flange member by forcibly curling the brim portions of said shingle members upwardly against outer surfaces of said vertical walls and adjacent said deformable flap members, and said flap members being deformed in situ so as to cover and grip the brim portions, said flange member and said shelter member means being integrally formed from a unitary piece of material.

2. An elongated shingle assembly as claimed in claim 1, wherein said flap members are connected to, and extend outwardly from, the upper ends of the vertical walls.

3. An elongated shingle assembly as claimed in claim 1 wherein said means for interconnecting said pair of flap members with said horizontal member comprises a pair of vertical members, each of said vertical members connecting said flap member with said horizontal member.

4. An elongated shingle assembly as claimed in claim 1 wherein said flap members, in a bent position, press against the outer surfaces of the brim portion of the shingle members so that the shingle member edges are gripped, covered and waterproof.

5. An elongated shingle assembly for a roof comprising:

(a) a longitudinally-extending flange member comprising a base portion adapted to be connected to a roof, a pair of vertical walls extending from said base portion, said walls being spaced apart and parallel to each other and having inner surfaces facing each other and outer surfaces facing away from each other, (b) a pair of flat shingle members each having a longitudinally-extending brim portion positioned on either side of said flange member, the brim portions being upwardly deformed in an assembled condition; and (c) a shelter member integral with the flange member for protecting said brim portions of said shingle members and joining the protected brim portions to said flange member comprising a concave member extending between said pair of vertical walls and a pair of deformable flap members each extending away from said concave member over said vertical walls, said deformable flap members being deformed in situ towards said vertical walls and covering said brim portions of said shingle members positioned in a forcibly upwardly curved manner against outer surfaces of said vertical walls, the covered brim portions being gripped between the deformed flap members and the vertical walls, said flange member and said shelter member being integrally formed from a unitary piece of material.

6. An elongated shingle assembly as claimed in claim 5 wherein said base portion includes a plurality of openings adapted to receive means for connecting the base portion to a roof and wherein said flap members are deformable to press against the outer surfaces of the brim portion of the shingle members so that the shingle member edges are gripped, covered and waterproofed, said shingle members when being gripped preventing water from reaching the openings in said base portion.

7. An elongated shingle assembly as claimed in claim 5 wherein said concave member forms a guide zone for a tool for moving said flap members towards said vertical walls.

* * * * *